US006695992B2

(12) United States Patent
Reneker

(10) Patent No.: US 6,695,992 B2
(45) Date of Patent: Feb. 24, 2004

(54) PROCESS AND APPARATUS FOR THE PRODUCTION OF NANOFIBERS

(75) Inventor: Darrell H. Reneker, Akron, OH (US)

(73) Assignee: The University of Akron, Akron, OH (US)

( * ) Notice: Subject to any disclaimer, the term of this patent is extended or adjusted under 35 U.S.C. 154(b) by 0 days.

(21) Appl. No.: 10/054,627

(22) Filed: Jan. 22, 2002

(65) Prior Publication Data

US 2003/0137069 A1 Jul. 24, 2003

(51) Int. Cl.[7] ..... D01D 5/092; D01D 5/098; C01B 31/02; D01F 9/145; D04H 3/03

(52) U.S. Cl. ..... 264/29.1; 264/29.2; 264/85; 264/103; 264/555; 425/72.2; 425/382.2

(58) Field of Search ..... 264/6, 12, 29.1, 264/29.2, 85, 103, 115, 518, 555; 425/7, 72.2, 83.1, 382.2

(56) References Cited

U.S. PATENT DOCUMENTS

| | | | | |
|---|---|---|---|---|
| 4,167,548 A | | 9/1979 | Arduini et al. | |
| 4,734,227 A | | 3/1988 | Smith | |
| 4,815,660 A | | 3/1989 | Boger | |
| 4,891,249 A | | 1/1990 | McIntyre | |
| 5,260,003 A | * | 11/1993 | Nyssen et al. | 264/6 |
| 5,273,212 A | | 12/1993 | Gerhardus et al. | |
| 5,421,921 A | | 6/1995 | Gill et al. | |
| 5,476,616 A | | 12/1995 | Schwarz | |
| 5,589,152 A | | 12/1996 | Tennent et al. | |
| 5,613,637 A | | 3/1997 | Schmon | |
| 5,617,997 A | | 4/1997 | Kobayashi et al. | |
| 5,654,040 A | | 8/1997 | Matsunaga | |

FOREIGN PATENT DOCUMENTS

| | | |
|---|---|---|
| DE | 19543606 A1 | 5/1996 |
| EP | 0 173 333 A2 | 3/1986 |
| FR | 2 054 358 | 4/1971 |
| GB | 609 167 | 9/1948 |

OTHER PUBLICATIONS

"Superfine Thermoplastic Fibers" by Van. A. Wente, *Industrial and Engineering Chemistry*, vol. 48, No. 8, 1956.
"Man–Made Fibers" by R.W.Moncrieff, Wiley Interscience Division, John Wiley & Sons, Inc., pp. 690–693, 1970.
"Man–Made Fibers" by R.W. Moncrieff, A Halsted Press Book, John Wiley & Sons, Inc., pp. 797–799, 1975.
"Polypropylene Fibers—Science and Technology" by M. Ahmed, *Textile Science and Technology 5*, pp. 434–461, 1982.
"Nanofibers for Engineered Textiles" by Darrell H. Reneker, UMIST—Textiles Engineered for Performance, Apr. 20–22, 1998, 11 pages.

* cited by examiner

*Primary Examiner*—Leo B. Tentoni
(74) *Attorney, Agent, or Firm*—Roetzel & Andress

(57) ABSTRACT

An apparatus for forming a non-woven mat of nanofibers by using a pressurized gas stream includes paralell, spaced apart, first, second, and third members, each having a supply end and an opposing exit end. The second member is located apart from and adjacent to the first member. The exit end of the second member extends beyond the exit end of the first member. The first and second members define a first supply slit. The third member is located apart from and adjacent to the first member on the opposite side of the first member from the second member. The first and third members define a first gas slit, and the exit ends of the first, second and third members define a gas jet space. A method for forming a non-woven mat of nanofibers utilizes this nozzle.

19 Claims, 2 Drawing Sheets

PROCESS AND APPARATUS FOR THE PRODUCTION OF NANOFIBERS

This invention was made with government support under cooperative agreements awarded by the U.S. Army, U.S. Air Force, and the National Science Foundation. The government may have certain rights to the invention.

BACKGROUND OF THE INVENTION

Nanofiber technology has not yet developed commercially and therefore engineers and entrepreneurs have not had a source of nanofiber to incorporate into their designs. Uses for nanofibers will grow with improved prospects for cost-efficient manufacturing, and development of significant markets for nanofibers is almost certain in the next few years. The leaders in the introduction of nanofibers into useful products are already underway in the high performance filter industry. In the biomaterials area, there is a strong industrial interest in the development of structures to support living cells. The protective clothing and textile applications of nanofibers are of interest to the designers of sports wear, and to the military, since the high surface area per unit mass of nanofibers can provide a fairly comfortable garment with a useful level of protection against chemical and biological warfare agents.

Carbon nanofibers are potentially useful in reinforced composites, as supports for catalysts in high temperature reactions, heat management, reinforcement of elastomers, filters for liquids and gases, and as a component of protective clothing. Nanofibers of carbon or polymer are likely to find applications in reinforced composites, substrates for enzymes and catalysts, applying pesticides to plants, textiles with improved comfort and protection, advanced filters for aerosols or particles with nanometer scale dimensions, aerospace thermal management application, and sensors with fast response times to changes in temperature and chemical environment. Ceramic nanofibers made from polymeric intermediates are likely to be useful as catalyst supports, reinforcing fibers for use at high temperatures, and for the construction of filters for hot, reactive gases and liquids.

It is known to produce nanofibers by using electrospinning techniques. These techniques, however, have been problematic because some spinnable fluids are very viscous and require higher forces than electric fields can supply before sparking occurs, i.e., there is a dielectric breakdown in the air. Likewise, these techniques have been problematic where higher temperatures are required because high temperatures increase the conductivity of structural parts and complicate the control of high electrical fields.

It is known to use pressurized gas to create polymer fibers by using melt-blowing techniques. According to these techniques, a stream of molten polymer is extruded into a jet of gas. These polymer fibers, however, are rather large in that the fibers are typically greater than 1,000 nanometers in diameter and more typically greater than 10,000 nanofibers in diameter. U.S. Pat. No. 3,849,241 to Butin et al., discloses a melt-blowing apparatus which produces fibers having a diameter between about 0.5 microns and 5 microns.

A nozzle which uses pressurized gas to form nanofibers is known from U.S. Pat. No. 6,382,526, the disclosure of which is hereby incorporated by reference.

It is also known to combine electrospinning techniques with melt-blowing techniques. But, the combination of an electric field has not proved to be successful in producing nanofibers inasmuch as an electric field does not produce stretching forces large enough to draw the fibers because the electric fields are limited by the dielectric breakdown strength of air.

Many nozzles and similar apparatus that are used in conjunction with pressurized gas are also known in the art. For example, the art for producing small liquid droplets includes numerous spraying apparatus including those that are used for air brushes or pesticide sprayers. But, there is a need for an apparatus or nozzle capable of producing non-woven mats of nanofibers.

SUMMARY OF THE INVENTION

It is therefore an aspect of the present invention to provide a method for forming a non-woven mat of nanofibers.

It is another aspect of the present invention to provide a method for forming a non-woven mat of nanofibers, the nanofibers having a diameter less than about 3,000 nanometers.

It is a further aspect of the present invention to provide an economical and commercially viable method for forming a non-woven mat of nanofibers.

It is still another aspect of the present invention to provide an apparatus that, in conjunction with pressurized gas, produces a non-woven mat of nanofibers.

It is yet another aspect of the present invention to provide a method for forming a non-woven mat of nanofibers from fiber-forming polymers.

It is still yet another aspect of the present invention to provide a method for forming a non-woven mat of nanofibers from fiber-forming ceramic precursors.

It is still yet another aspect of the present invention to provide a method for forming a non-woven mat of nanofibers from fiber-forming carbon precursors.

It is another aspect of the present invention to provide a method for forming a non-woven mat of nanofibers by using pressurized gas.

It is yet another aspect of the present invention to provide an apparatus that, in conjunction with pressurized gas, produces a non-woven mat of nanofibers, the nanofibers having a diameter less than about 3,000 nanometers.

At least one or more of the foregoing aspects, together with the advantages thereof over the known art relating to the manufacture of non-woven mats of nanofibers, will become apparent from the specification that follows and are accomplished by the invention as hereinafter described and claimed.

In general the present invention provides a method for forming a nonwoven mat of nanofibers comprising the steps of feeding a fiber-forming material into a first slit between a first and a second member, wherein each of said first and second members have an exit end, and wherein said second member exit end protrudes from said first member exit end such that fiber-forming material exiting from said first slit forms a film on a portion of said second member which protrudes from said first member, and feeding a pressurized gas through a second slit between said first member and a third member, said second slit being located adjacent to said first slit such that pressurized gas exiting from said second slit contacts said film and ejects the fiber forming material from said exit end of said second member in the form of a plurality of strands of fiber-forming material that solidify and form a mat of nanofibers, said nanofibers having a diameter up to about 3,000 nanometers.

The present invention also includes an apparatus for forming a nonwoven mat of nanofibers by using a pressurized gas stream comprising a first member having a supply end defined by one side across the width of the first member and an opposing exit end defined by one side across the width of the first member; a second member having a supply end defined by one side across the width of the second member and an opposing exit end defined by one side across the width of the second member, the second member being located apart from and adjacent to the first member, the length of the second member extending along the length of the first member, the exit end of second member extending beyond the exit end of the first member, wherein the first and second members define a first supply slit; and a third member having a supply end defined by one side across the width of the third member and an opposing exit end defined by one side across the width of the third member, the third member being located apart from and adjacent to the first member on the opposite side of the first member from the second member, the length of the third member extending along the length of the first member, wherein the first and third members define a first gas slit, and wherein the exit ends of the first, second and third members define a gas jet space.

DETAILED DESCRIPTION OF THE INVENTION

It has now been found that a non-woven mat of nanofibers can be produced by using pressurized gas. This is generally accomplished by a process wherein the mechanical forces supplied by an expanding gas jet create nanofibers from a fluid that flows through an apparatus. This process may be referred to as nanofibers by gas jet (NGJ). NGJ is a broadly applicable process that produces nanofibers from any spinnable fluid or fiber-forming material.

In general, a spinnable fluid or fiber-forming material is any fluid or material that can be mechanically formed into a cylinder or other long shapes by stretching and then solidifying the liquid or material. This solidification can occur by, for example, cooling, chemical reaction, coalescence, or removal of a solvent. Examples of spinnable fluids include molten pitch, polymer solutions, polymer melts, polymers that are precursors to ceramics, and molten glassy materials. Some preferred polymers include nylon, fluoropolymers, polyolefins, polyimides, polyesters, and other engineering polymers or textile forming polymers. The terms spinnable fluid and fiber-forming material may be used interchangeably throughout this specification without any limitation as to the fluid or material being used. As those skilled in the art will appreciate, a variety of fluids or materials can be employed to make fibers including pure liquids, solutions of fibers, mixtures with small particles and biological polymers.

The present invention provides an apparatus for forming a non-woven mat of nanofibers comprising means for contacting a fiber-forming material with a gas within the apparatus, such that a plurality of strands of fiber-forming material are ejected from the apparatus, wherein the strands of fiber-forming material solidify and form nanofibers having a diameter up to about 3000 nanometers.

Figures 1, 2, 3:
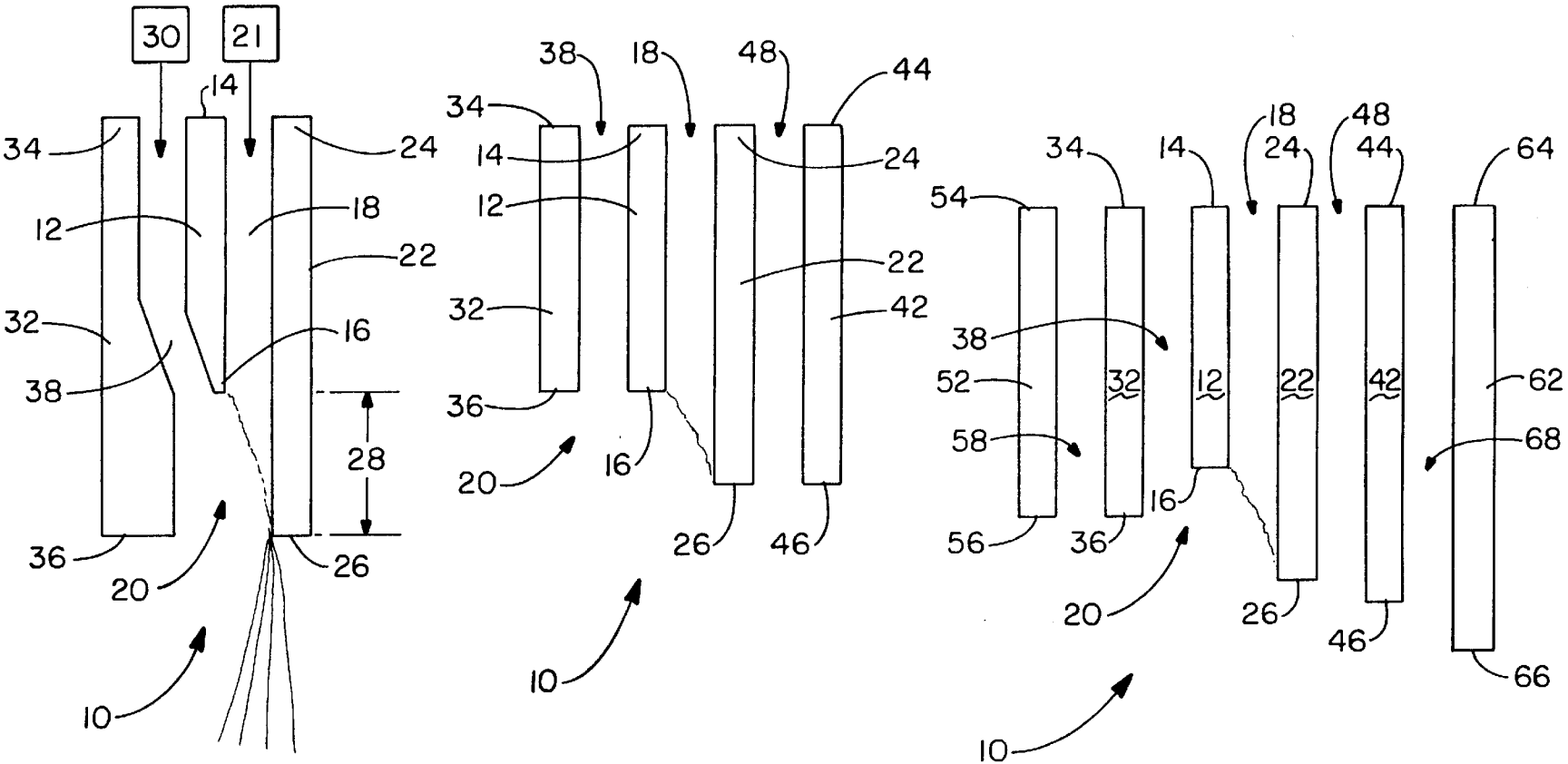
FIG. 1 is a schematic diagram of an apparatus for producing a non-woven mat of nanofibers according to this invention.
FIG. 2 is a schematic representation of another embodiment of the apparatus of this invention, wherein the apparatus includes an additional lip cleaner plate.
FIG. 3 is a schematic representation of another embodiment of the apparatus of this invention, wherein the apparatus includes an outer gas shroud assembly.

A preferred apparatus 10 that is employed in practicing the process of this invention is best described with reference to FIG. 1. It should be understood that gravity will not impact the operation of the apparatus of this invention, but for purposes of explaining the present invention, reference will be made to the apparatus as it is vertically positioned as shown in the figures. Apparatus 10 includes a first plate or member 12 having a supply end 14 defined by one side across the width of the plate and an opposing exit end 16 defined by one side across the width of the plate. First plate 12 may taper at end 16, as shown in FIG. 1, or may otherwise be as thin as possible at exit end 16 according to the design constraints of a particular embodiment.

Located adjacent to and apart from first plate 12 is a second plate or member 22. The length of second plate 22 extends along the length of first plate 12. Second plate 22 has a supply end 24 defined by one side across the width of the plate and an opposing exit end 26 defined by one side across the width of the plate. First plate 12 and second plate 22 define a first supply cavity or slit 18. In a preferred embodiment, width of first supply cavity or slit 18 at exit end 16 of first plate 12 is from about 0.02 mm to about 1 mm, and more preferably from about 0.05 mm to about 0.5 mm. Although first plate 12 and second plate 22 are shown as being parallel to each other, this is not required, provided that the distance between plates 12 and 22 at exit end 16 is within the above range.

Exit end 26 of second plate 22 extends beyond exit end 16 of first plate 12. The distance between exit end 26 and exit end 16 is a wall flow length 28. First supply slit 18 may be specifically adapted to carry a fiber-forming material.

The apparatus further contains a third plate or member 32 having supply end 34 defined by one side across the width of third plate 32 and an opposing exit end 36 defined by one side across the width of third plate 32. The length of third plate 32 extends along the length of second plate 22. First plate 12 and third plate 32 define a first gas column or slit 38. Third plate 32 may terminate at exit end 36 on an identical plane as either exit end 26 (as shown in FIG. 1) or exit end 16 (as shown in FIG. 2) or it may terminate on a plane different from either of ends 16 and 26 (as shown in FIG. 3). In a preferred embodiment, the distance between first plate 12 and third plate 32 at the exit end 16 is from about 0.5 mm to about 5 mm, and more preferably from about 1 mm to about 2 mm. Third plate 32 may be shaped such that first gas column or slit 38 is angled toward first supply slit 18.

End 16, end 26, and end 36 define a gas jet space 20. The position of plates 12, 22, and 32 may be adjustable relative to exit ends 16, 26, and 36 such that the dimensions of gas jet space 20, including wall flow length 28, are adjustable, depending on the fiber forming material used, the temperature at which the fibers are formed, the gas flow rate and the desired diameter of the resulting nanofibers, among other factors. In one particular embodiment, wall flow length 28 is adjustable from about 0.1 to about 10 millimeters. Likewise, the overall length of plates 12, 22, and 32 can vary depending upon construction conveniences, heat flow considerations, and shear flow in the fluid provided that end 26 of plate 22 protrudes from the plane of end 16 of plate 12. Furthermore, plates 12, 22 and 32 may be any width according to the demands of a particular application, the desired width of a resulting nanofiber mat, production convenience, or other factors.

According to the present invention, a non-woven mat of nanofibers is produced by using the apparatus of FIG. 1 by the following method. Fiber-forming material is provided by a source 21, and fed through first supply cavity or slit 18. The fiber-forming material is directed into gas jet space 20. Simultaneously, pressurized gas is forced from a gas source 30 through first gas cavity or slit 38 and into the gas jet space 20.

Within gas jet space 20 it is believed that the fiber-forming material is in the form of a film. In other words, fiber-forming material exiting from slit 18 into the gas jet space 20 forms a thin layer of fiber-forming material on the side of second plate 22 within gas jet space 20. This layer of fiber-forming material is subjected to shearing deformation by the gas jet exiting from slit 38 until it reaches end 26. The film may be of varying thickness and is generally expected to decrease in thickness toward end 26. In those embodiments where first gas column or slit 38 is angled toward first supply slit 18, gas flows over the fiber forming material in gas jet space 20 at high relative velocity. Near the lip, it is believed that the layer of fiber-forming material is driven and carried by the sheer forces of the gas and is blown apart into many small strands 40 by the expanding gas and ejected from end 26 along with any jets of fiber-forming material launched at the crest of breaking waves on the surface of the fiber-forming material layer as shown in FIG. 1. Once ejected from apparatus 10, these strands solidify and form nanofibers. This solidification can occur by cooling, chemical reaction, coalescence, ionizing radiation or removal of solvent. It is also envisioned that solidified film forming material may be present within gas jet space 20.

As noted above, the fibers produced according to this process are nanofibers and have an average diameter that is less than about 3,000 nanometers, more preferably from about 3 to about 1,000 nanometers, and even more preferably from about 10 to about 500 nanometers. The diameter of these fibers can be adjusted by controlling various conditions including, but not limited to, temperature and gas pressure. The length of these fibers can widely vary to include fibers that are as short as about 0.01 mm up to those fibers that are many km in length. Within this range, the fibers can have a length from about 1 mm to about 1 km, and more narrowly from about 1 mm to about 1 cm. The length of these fibers can be adjusted by controlling the solidification rate.

As discussed above, pressurized gas is forced through slit 38 and into jet space 20. This gas should be forced through slit 38 at a sufficiently high pressure so as to carry the fiber forming material along wall flow length 28 and create nanofibers. Therefore, in one particular embodiment, the gas is forced through slit 38 under a pressure of from about 10 pounds per square inch (psi) to about 5,000 psi. In another embodiment, the gas is forced through slit 38 under a pressure of from about 50 psi to about 500 psi.

The term gas as used throughout this specification, includes any gas. Non-reactive gases are preferred and refer to those gases, or combinations thereof, that will not deleteriously impact the fiber-forming material. Examples of these gases include, but are not limited to, nitrogen, helium, argon, air, carbon dioxide, steam fluorocarbons, fluorochlorocarbons, and mixtures thereof. It should be understood that for purposes of this specification, gases will also refer to those super heated liquids that evaporate at the apparatus when pressure is released, e.g., steam. It should further be appreciated that these gases may contain solvent vapors that serve to control the rate of drying of the nanofibers made from polymer solutions. Still further, useful gases include those that react in a desirable way, including mixtures of gases and vapors or other materials that react in a desirable way. For example, it may be useful to employ oxygen to stabilize the production of nanofibers from pitch. Also, it may be useful to employ gas streams that include molecules that serve to crosslink polymers. Still further, it may be useful to employ gas streams that include metals or metal compounds that serve to improve the production of ceramics.

In another embodiment, apparatus 10 additionally comprises a fourth plate or member 42 as shown in FIGS. 2 and 3. Plate 42 is located adjacent to and apart from second plate 22 on the opposite side of plate 22 from plate 12. The length of plate 42 extends along the length of second plate 22. Fourth plate 42 has a supply end 44 defined by one side across the width of fourth plate 42 and an opposing exit end 46 defined by one side across the width of fourth plate 42. Second plate 22 and fourth plate 42 define a second gas column or slit 48. Fourth plate 42 may terminate at exit end 46 on an identical plane as exit end 26 (as shown in FIG. 2) or it may terminate on a plane different from end 26 (as shown in FIG. 3).

Fibers are formed using the apparatus shown in FIG. 2 as described above, and additionally includes feeding pressurized gas through second gas slit 48, exiting at exit end 46 thereby preventing the build up of residual amounts of fiber-forming material that can accumulate at exit end 26 of second plate 22. The gas that is forced through gas slit 48 should be at a sufficiently high pressure so as to prevent accumulation of excess fiber-forming material at exit end 26, yet should not be so high that it disrupts the formation of fibers. Therefore, in one preferred embodiment, the gas is forced through the second gas slit 48 under a pressure of from about 0 to about 1,000 psi, and more preferably from about 10 psi to about 100 psi. The gas flow from gas slit 48 also affects the exit angle of the strands of fiber-forming material exiting from end 26, and therefore gas flowing from second gas slit 48 of this environment serves both to clean end 26 and control the flow of exiting fiber strands.

In yet another embodiment, which is shown in FIG. 3, a fifth plate or member 52 is positioned adjacent to and apart from third plate 32 on the opposite side of plate 32 from plate 12. The length of fifth plate 52 extends along the length of third plate 32. Fifth plate 52 has a supply end 54 defined by one side across the width of fifth plate 52 and an opposing exit end 56 defined by one side across the width of fifth plate 52. Fifth plate 52 and third plate 32 define a first shroud gas column or slit 58. Fifth plate 52 may terminate at exit end 56 on an identical plane as exit end 36 (as shown in FIG. 3) or it may terminate on a plane different from end 36 (not shown). A sixth plate or member 62 may be positioned adjacent to and apart from fourth plate 42 on the opposite side of plate 42 from plate 22. The length of plate 62 extends along the length of fourth plate 42. Sixth plate 62 has a supply end 64 defined by one side across the width of sixth plate 62 and an opposing exit end 66 defined by one side across the width of sixth plate 62. Sixth plate 62 and fourth plate 42 define a second shroud gas column or slit 68. Sixth plate 62 may terminate at exit end 66 on an identical plane as exit end 26 (not shown) or it may terminate on a plane different from end 26 (as shown in FIG. 3). Pressurized gas at a controlled temperature is forced through first and second shroud gas slits 58 and 68 so that it exits from slits 58 and 68 and thereby creates a moving shroud of gas around the nanofibers. This shroud of gas may help control the cooling rate, solvent evaporation rate of the fluid, or the rate chemical reactions occurring within the fluid. It should be understood that the general shape of the gas shroud is controlled by the width of the slits 58 and 68 and the vertical position of ends 56 and 66 with respect to ends 36 and 46. The shape is further controlled by the pressure and volume of gas flowing through slits 58 and 68. Therefore, the dimensions of shroud gas slits 58 and 68 may be adjustable. It should be further understood that the gas flowing through slits 58 and 68 is preferably under a relatively low pressure and at a relatively high volume flow rate in comparison with the gas flowing through slit 38.

Figure 4:
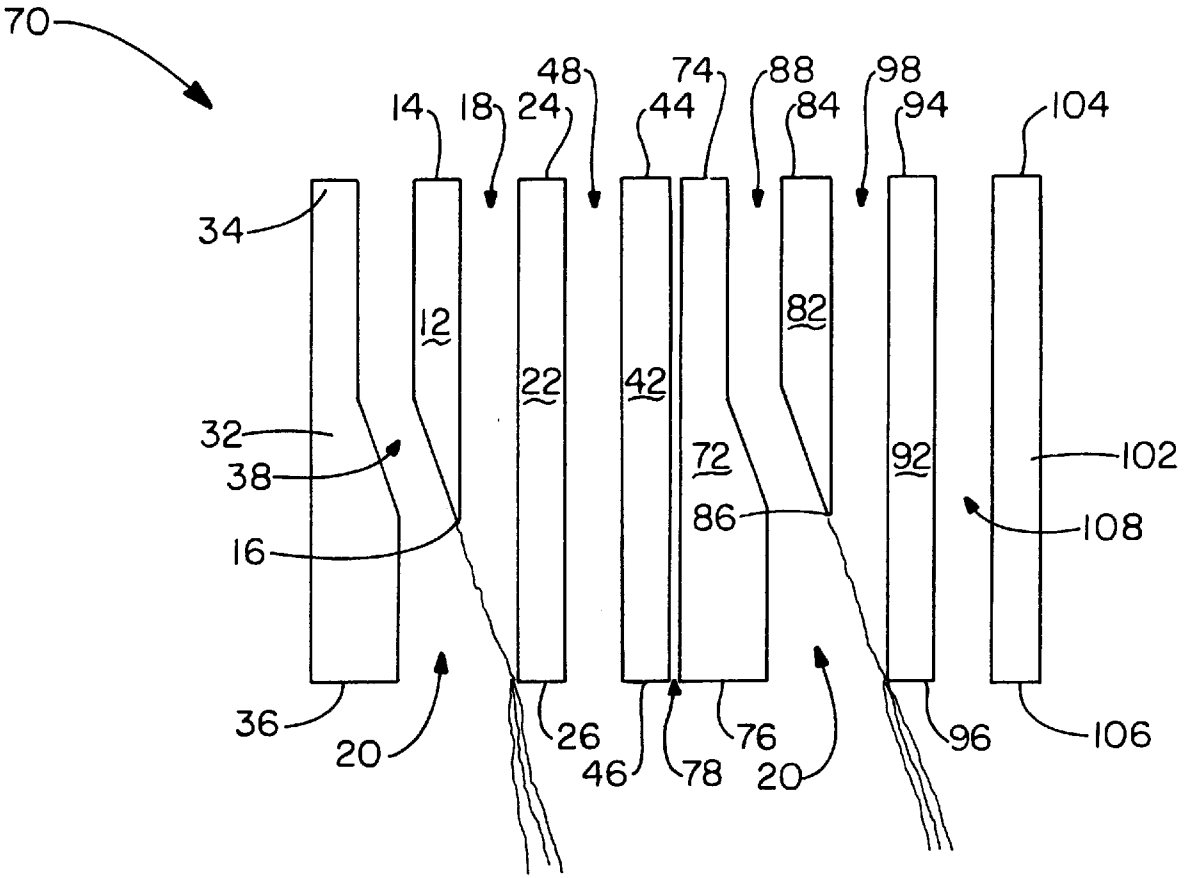
FIG. 4 is a schematic representation of another embodiment of the apparatus of the invention, wherein the apparatus contains a plurality of fiber-forming material supply slits.

It is also envisioned that the apparatus of the present invention may include additional plates defining alternating supply cavities or slits and gas cavities or slits. One such arrangement is shown in FIG. 4. Such an apparatus may be used to produce a non-woven web or mat comprising more than one type of fiber. For example, a non-woven mat of nanofibers might be produced from two or more fiber-forming materials. Alternatively, a single fiber forming material might be used to simultaneously form fibers which differed in their physical characteristics such as length or diameter, for example. Such an apparatus may also be used to simply increase the rate of production of a single type of fiber. In the embodiment shown in FIG. 4, the apparatus 70 comprises a first plate or member 12, a second plate or member 22, a third plate or member 32, and a fourth plate or member 42, arranged as described above. Apparatus 70 additionally comprises a seventh plate or member 72 which is positioned adjacent to and optionally apart from fourth plate 42 on the opposite side of plate 42 from plate 22. The length of plate 72 extends along the length of fourth plate 42. Seventh plate 72 has a supply end 74 defined by one side across the width of seventh plate 72 and an opposing exit end 76 defined by one side across the width of seventh plate 72. Seventh plate 72 and fourth plate 42 may optionally define a heat flow reducing space 78. Space 78 may be desired when two or more types of fibers are being formed at two or more different temperatures. Alternatively, seventh plate 72 and fourth plate 42 may touch or a single plate or member may take the place of seventh plate 72 and fourth plate 42, especially in those applications where heat transfer is not a concern. Seventh plate 72 may terminate at exit end 76 on an identical plane as exit end 46, as shown in FIG. 4, or it may terminate on a plane different from end 46 (not shown).

An eighth plate or member 82 is positioned adjacent to and apart from seventh plate 72 on the opposite side of plate 72 from plate 42. The length of plate 82 extends along the length of seventh plate 72. Eighth plate 82 has a supply end 84 defined by one side across the width of eighth plate 82 and an opposing exit end 86 defined by one side across the width of eighth plate 82. Eighth plate 82 and seventh plate 72 define a third gas column or slit 88. Eighth plate 82 may terminate on a plane different from end 76 as shown in FIG. 4. Eighth plate 82 may taper at end 86. Seventh plate 72 may also be shaped in such a way that third gas column or slit 88 is angled to match the taper of eighth plate 82 at end 86 or to otherwise influence the direction of gas exiting slit 88.

A ninth plate or member 92 is positioned adjacent to and apart from eighth plate 82 on the opposite side of plate 82 from plate 72. The length of plate 92 extends along the length of eighth plate 82. Ninth plate 92 has a supply end 94 defined by one side across the width of plate 92 and an opposing exit end 96 defined by one side across the width of ninth plate 92. Ninth plate 92 and eighth plate 82 define a second supply column or slit 98.

In this embodiment, ends 16, 26, and 36, and ends 76, 86, and 96 define gas jet spaces 20. The position of plates 12, 22, and 32 and plates 72, 82, and 92 may be adjustable relative to exit ends 16, 26, and 36 and exit ends 76, 86, and 96, respectively, such that the dimensions of gas jet spaces 20, are adjustable for the fiber forming material used, the temperature at which the fibers are formed, the gas flow rate and the desired diameter of the resulting nanofibers, among other factors. Likewise, the overall length of plates 12, 22, and 32 and plates 72, 82, and 92 can vary depending upon construction conveniences, heat flow considerations, and shear flow in the fluid provided that end 26 of plate 22 protrudes from the plane of end 16 of plate 12 and provided that end 96 of plate 92 protrudes from the plane of end 86 of plate 82. Furthermore, plates 12, 22, 32, 72, 82, and 92 may be any width according to the demands of a particular application, the desired width of a resulting nanofiber mat, production convenience, or other factors.

A tenth plate or member 102 is optionally positioned adjacent to and apart from ninth plate 92 on the opposite side of plate 92 from plate 82. The length of plate 102 extends along the length of ninth plate 92. Tenth plate 102 has a supply end 104 defined by one side across the width of plate 102 and an opposing exit end 106 defined by one side across the width of tenth plate 102. Tenth plate 102 and ninth plate 92 define a fourth gas column or slit 108. Tenth plate 102 may terminate at exit end 106 on an identical plane as exit end 96 as shown in FIG. 4 or it may terminate on a plane different from end 96 (not shown).

A non-woven mat of nanofibers may be produced by using the apparatus of FIG. 4 by the following method. One or more fiber-forming material is fed through first supply cavity or slit 18 and second supply cavity or slit 98. The fiber-forming material is directed into gas jet spaces 20. Simultaneously, pressurized gas is forced through first gas cavity or slit 38 and third gas cavity or slit 88 and into gas jet spaces 20.

Within gas jet spaces 20 it is believed that the fiber-forming material is in the form of a film. In other words, fiber-forming material exiting from slits 18 and 98 into gas jet spaces 20, forms a thin layer of fiber-forming material on the side of second plate 22 and the side of plate 92 and within gas jet spaces 20. These layers of fiber-forming material are subjected to shearing deformation by the gas jet exiting from slits 38 and until they reach ends 26 and 96. The films may be of varying thickness and are generally expected to decrease in thickness toward end 26. In those embodiments where first gas column or slit 38 is angled toward first supply slit 18, or third gas column or slit 88 is angled toward second supply slit 98, gas flows over the fiber forming material in gas jet space 20 at high relative velocity. Near ends 26 and 96, it is believed that the layers of fiber-forming material are driven and carried by the shear forces of the gas and are blown apart into many small strands by the expanding gas and ejected from ends 26 and 96 along with any jets of fiber-forming material launched at the crest of breaking waves on the surface of the fiber-forming material layer. Once ejected from apparatus 70, these strands solidify and form nanofibers. This solidification can occur by cooling, chemical reaction, coalescence, ionizing radiation or removal of solvent. It is also envisioned that solidified film forming material may be present within gas jet spaces 20.

In practicing the present invention, spinnable fluid or fiber-forming material can be delivered to slit 18 by any suitable technique known in the art. For example, fiber-forming material may be supplied to the apparatus in a batch-wise operation or the fiber-forming material can be delivered on a continuous basis. Suitable delivery methods are described in U.S. Pat. No. 6,382,526 and International Publication No. WO 00/22207, the contents of which are incorporated by reference herein.

It should be understood that there are many conditions and parameters that will impact the formation of fibers according to the present invention. For example, the pressure of the gas moving through any of the columns of the apparatus of this invention may need to be manipulated based on the fiber-forming material that is employed. Also, the fiber-forming material being used or the desired characteristics of the resulting nanofiber may require that the fiber-forming material itself or the various gas streams be heated. For example, the length of the nanofibers can be adjusted by varying the temperature of the shroud air. Where the shroud air is cooler, thereby causing the strands of fiber-forming material to quickly freeze or solidify, longer nanofibers can be produced. On the other hand, where the shroud air is hotter, and thereby inhibits solidification of the strands of fiber-forming material, the resulting nanofibers will be shorter in length. It should also be appreciated that the temperature of the pressurized gas flowing through slits 38 and 48 can likewise be manipulated to achieve or assist in these results. For example, acicular nanofibers of mesophase pitch can be produced where the shroud air is maintained at about 350° C. This temperature should be carefully controlled so that it is hot enough to cause the strands of mesophase pitch to be soft enough and thereby stretch and neck into short segments, but not too hot to cause the strands to collapse into droplets. Preferred acicular nanofibers have lengths in the range of about 1,000 to about 2,000 nanometers.

Those skilled in the art will be able to heat the various gas flows using techniques that are conventional in the art. Likewise, the fiber-forming material can be heated by using techniques well known in the art. For example, heat may be applied to the fiber-forming material entering the first supply slit 18, to the pressurized gas entering slit 38 or slit 48, or to the supply tube itself by a heat source (not shown), for example. In one particular embodiment, the heat source can include coils that are heated by a source.

In one specific embodiment the present invention, a non-woven mat of carbon nanofiber precursors are produced. Specifically, nanofibers of polymer, such as polyacrylonitrile, are spun and collected by using the process and apparatus of this invention. These polyacrylonitrile fibers are heated in air to a temperature of about 200° C. to about 400° C., optionally under tension, to stabilize them for treatment at higher temperature. These stabilized fibers are then converted to carbon fibers by heating to between approximately 800° C. and 1700° C. under inert gas. In this carbonization process, all chemical groups, such as HCN, $NH_3$, $CO_2$, $N_2$ and hydrocarbons, are removed. After carbonization, the fibers are heated to temperatures in the range of about 2000° C. to about 3000° C. This process, called graphitization, makes carbon fibers with aligned graphite crystallites.

In another specific embodiment, carbon nanofiber precursors are produced by using mesophase pitch. These pitch fibers can then be stabilized by heating in air to prevent melting or fusing during high temperature treatment, which is required to obtain high strength and high modulus carbon fibers. Carbonization of the stabilized fibers is carried out at temperatures between about 1000° C. and about 1700° C. depending on the desired properties of the carbon fibers.

In another embodiment, NGJ is combined with electrospinning techniques. In these combined process, NGJ improves the production rate while the electric field maintains the optimal tension in the jet to produce orientation and avoid the appearance of beads on the fibers. The electric field also provides a way to direct the nanofibers along a desired trajectory through processing machinery, heating ovens, or to a particular position on a collector. Electrical charge on the fiber can also produce looped and coiled nanofibers that can increase the bulk of the non-woven fabric made from these nanofibers.

Also, metal containing polymers can be spun into non-woven mats of nanofibers and converted to ceramic nanofibers. This is a well known route to the production of high quality ceramics. The sol-gel process utilizes similar chemistry, but here linear polymers would be synthesized and therefore gels would be avoided. In some applications, a wide range of diameters would be useful. For example, in a sample of fibers with mixed diameters, the volume-filling factor can be higher because the smaller fibers can pack into the interstices between the larger fibers.

Blends of nanofibers and textile size fibers may have properties that would, for example, allow a durable non-woven fabric to be spun directly onto a person, such as a soldier or environmental worker, to create protective clothing that could absorb, deactivate, or create a barrier to chemical and biological agents.

It should also be appreciated that the average diameter and the range of diameters is affected by adjusting the gas temperature, the flow rate of the gas stream, the temperature of the fluid, and the flow rate of fluid. The flow of the fluid can be controlled by a valve arrangement, by an extruder, or by separate control of the pressure in the container and in the center tube, depending on the particular apparatus used.

It should thus be evident that the NGJ methods and apparatus disclosed herein are capable of providing nanofibers by creating a thin layer of fiber-forming material on the side of a plate, and this layer is subjected to shearing deformation until it reaches the exit end of the plate. There, the layer of fiber-forming material is blown apart, into many small jets, by the expanding gas. No apparatus has ever been used to make non-woven mats of nanofibers by using pressurized gas. Further, the NGJ process creates fibers from spinnable fluids, such as mesophase pitch, that can be converted into high strength, high modulus, high thermal conductivity graphite fibers. It can also produce nanofibers from a solution or melt. It may also lead to an improved apparatus for production of small droplets of liquids. It should also be evident that NGJ produces nanofibers at a high production rate. NGJ can be used alone or in combination with either or both melt blowing or electrospinning to produce useful mixtures of fiber geometries, diameters and lengths. Also, NGJ can be used in conjunction with an electric field, but it should be appreciated that an electric field is not required.

What is claimed is:

1. An apparatus for forming a non-woven mat of nanofibers by using a pressurized gas stream comprising:

a first member having a supply end defined by one side across the width of said first member and an opposing exit end defined by one side across the width of said first member;

a second member having a supply end defined by one side across the width of said second member and an opposing exit end defined by one side across the width of said second member, the second member being located apart from and adjacent to said first member, the length of said second member extending along the length of said first member, said exit end of said second member extending beyond said exit end of said first member, wherein said first and second members define a first supply slit; and a third member having a supply end defined by one side across the width of said third member and an opposing exit end defined by one side across the width of said third member, said third member being located apart from and adjacent to said first member on the opposite side of said first member from said second member, the length of said third member extending along the length of the first member, wherein said first and third members define a first gas slit, and wherein said exit ends of said first, second and third members define a gas jet space.

2. An apparatus for forming a non-woven mat of nanofibers according to claim 1, wherein the size of said gas jet space is adjustable.

3. An apparatus for forming a non-woven mat of nanofibers according to claim 1, wherein the gas jet space has a length which is adjustable between about 0.1 to about 10 millimeters.

4. An apparatus for forming a non-woven mat of nanofibers according to claim 1, wherein said first gas slit is adapted to carry a pressurized gas at a pressure of from about 10 to about 5000 pounds per square inch.

5. An apparatus for forming a non-woven mat of nanofibers according to claim 1, wherein said first supply slit is adapted to carry a fiber-forming material.

6. An apparatus for forming a non-woven mat of nanofibers according to claim 1, wherein said pressurized gas is selected from the group consisting of nitrogen, helium, argon, air, carbon dioxide, steam fluorocarbons, fluorochlorocarbons, and mixtures thereof.

7. An apparatus for forming a non-woven mat of nanofibers according to claim 1, wherein said first gas slit is angled toward said first supply slit.

8. An apparatus for forming a non-woven mat of nanofibers according to claim 1, further comprising a fourth member, said fourth member having a supply end defined by one side across the width of said fourth member and an opposing exit end defined by one side across the width of said fourth member, and wherein said fourth member is located adjacent to and apart from said second member on the opposite side of said second member from said first member, and further wherein the length of said fourth member extends along the length of said second member and wherein said second member and said fourth member define a second gas slit.

9. An apparatus for forming a non-woven mat of nanofibers according to claim 8, wherein said fourth member terminates at said exit end on an identical plane as said exit end of said second member.

10. An apparatus for forming a non-woven mat of nanofibers according to claim 8, wherein said fourth member terminates at said exit end on different plane than said exit end of said second member.

11. An apparatus for forming a non-woven mat of nanofibers according to claim 8, additionally comprising:

a fifth member, said fifth member having a supply end defined by one side across the width of said fifth member and an opposing exit end defined by one side across the width of said fifth member, and wherein said fifth member is located adjacent to and apart from said third member on the opposite side of said third member from said first member, further wherein the length of said fifth member extends along the length of said third member such that said fifth member and said third member define a first shroud gas slit; and a sixth member, said sixth member having a supply end defined by one side across the width of said sixth member and an opposing exit end defined by one side across the width of said sixth member, and wherein said sixth member is located adjacent to and apart from fourth member on the opposite side of said fourth member from said second member, further wherein the length of said sixth member extends along the length of said fourth member such that said sixth member and said fourth member define a second shroud gas slit.

12. An apparatus for forming a non-woven mat of nanofibers according to claim 8, additionally comprising:

a seventh member, said seventh member having a supply end defined by one side across the width of said seventh member and an opposing exit end defined by one side across the width of said seventh member, and wherein said seventh member is located adjacent to and apart from said fourth member on the opposite side of said fourth member from said second member, further wherein the length of said seventh member extends along the length of said fourth member;

an eighth member, said eighth member having a supply end defined by one side across the width of said eighth member and an opposing exit end defined by one side across the width of said eighth member, and wherein said eight member is located adjacent to and apart from said seventh member on the opposite side of said seventh member from said fourth member, further wherein the length of said eighth member extends along the length of said seventh member such that said seventh member and said eighth member define a third gas slit; and a ninth member, said ninth member having a supply end defined by one side across the width of said ninth member and an opposing exit end defined by one side across the width of said ninth member, and wherein said ninth member is located adjacent to and apart from said eighth member on the opposite side of said eighth member from said seventh member, said exit end of said ninth member extending beyond said exit end of said eighth member, further wherein the length of said ninth member extends along the length of said eighth member such that said ninth member and said eighth member define a second supply slit.

13. A method for forming a non-woven mat of nanofibers comprising the steps of:

feeding a fiber-forming material into a first supply slit between a first member and a second member, wherein said first and second members each have an exit end, and wherein said second member exit end protrudes from said first member exit end such that fiber-forming material exiting from said first supply slit forms a film on a portion of said second member which protrudes from said first member exit end;

feeding a pressurized gas through a first gas slit between said first member and a third member, said first gas slit being located adjacent to said first supply slit such that pressurized gas exiting from said slit contacts said second slit contacts said film in a gas jet space defined by said first, second, and third member exit ends, and ejects the fiber forming material from said exit end of said second member in the form of a plurality of strands of fiber-forming material that solidify and form a mat of nanofibers, said nanofibers having a diameter up to about 3,000 nanometers.

14. A method for forming a non-woven mat of nanofibers according to claim 13, additionally comprising the step of feeding a pressurized gas through a second gas slit between said second member and a fourth member, wherein said second gas slit is located adjacent to said first supply slit on an opposite side from said first gas slit such that said pressurized gas exiting from said second gas slit prevents the accumulation of fiber-forming material from on said exit end of said second member.

15. A method for forming a non-woven mat of nanofibers according to claim 14, additionally comprising the steps of feeding a shroud gas through a first gas shroud slit located adjacent to said first gas slit on an opposite side from said first supply slit, and feeding a shroud gas through a second shroud gas slit located adjacent to said second gas slit on an opposite side from said first supply slit.

16. A method for forming a non-woven mat of nanofibers according to claim 13, wherein said pressurized gas is selected from the group consisting of nitrogen, helium, argon, air, carbon dioxide, steam fluorocarbons, fluorochlorocarbons, and mixtures thereof.

17. A method for forming a non-woven mat of nanofibers according to claim 13, wherein the fiber forming material is selected from the group consisting of polyacrylonitrile and mesophase pitch.

18. A method for forming a non-woven mat of nanofibers according to claim 13, additionally comprising a step of carbonizing the mat of nanofibers by heating to a temperature between about 1000° C. and about 1700° C.

19. A method for forming a non-woven mat of nanofibers according to claim 13, wherein the fiber forming material is a metal-containing polymer.

* * * * *